United States Patent [19]

Knorre et al.

[11] 4,255,252

[45] Mar. 10, 1981

[54] PROCEDURE FOR THE REPROCESSING OF USED LUBRICATING OILS

[75] Inventors: Helmut Knorre, Seligenstadt; Manfred Langer, Karlstein; Gerhard Pohl, Hanau, all of Fed. Rep. of Germany

[73] Assignee: Deutsche Gold und Silber-Scheideanstalt Vormals Roessler, Frankfurt am Main, Fed. Rep. of Germany

[21] Appl. No.: 23,059

[22] Filed: Mar. 22, 1979

[30] Foreign Application Priority Data

Mar. 25, 1978 [DE] Fed. Rep. of Germany ..... 2813200

[51] Int. Cl.[3] ..... C10M 11/00

[52] U.S. Cl. ..... 208/182; 208/184; 208/185; 208/208 M; 208/258; 208/294

[58] Field of Search ..... 208/179, 181, 182, 184, 208/185, 180, 208 M, 258, 262, 294

[56] References Cited

U.S. PATENT DOCUMENTS

| | | | |
|---|---|---|---|
| 1,752,050 | 3/1930 | Young | 208/179 |
| 1,934,068 | 11/1933 | Jolly | 208/262 |
| 2,722,211 | 11/1956 | Hawkes | 208/208 M |
| 3,620,967 | 11/1971 | Gulick | 208/179 |
| 4,097,369 | 6/1978 | Ebel et al. | 208/183 |
| 4,101,414 | 7/1978 | Kim | 208/184 |

OTHER PUBLICATIONS

Gmelin, Handbuch Der Anorganischen Chemie, Natrium No. 21 (1965) Verlag Chemie, pp. XI, 613–616, 624, 625.

*Primary Examiner*—Brian E. Hearn

*Attorney, Agent, or Firm*—Beveridge, Degrandi, Kline and Lunsford

[57] ABSTRACT

A method for reprocessing used lubricating oils is disclosed wherein the oil is dried, treated with finely dispersed sodium metal at elevated temperature, the remaining free or organically bound metal is decomposed by means of an active hydrogen containing compounds, followed by distillation of the oil for recovery.

7 Claims, No Drawings

PROCEDURE FOR THE REPROCESSING OF USED LUBRICATING OILS

BACKGROUND OF THE INVENTION AND PRIOR ART

The invention relates to a procedure for the reprocessing of used lubricating oils by treating dried oil with finely dispersed sodium metal at elevated temperature and subsequent separation of the processed product by distillation.

The reprocessing of use lubricating oils is a problem of increasing economic and ecological importance. Hitherto, this regeneration has been carried out predominantly in accordance with the so-called acid tar process, whereby the predried, old oils from which the benzine has been extracted, are subjected to a treatment with 5 to 15% of concentrated sulfuric acid and the treated product is subsequently decolored with heat using 3 to 10% of bleaching clay.

This process is usable per se, however, it is imbued with a few serious disadvantages. For one thing, the acid oils and the acid residues lead to considerable undesirable odors in the vicinity of the processing installations. For another thing, the considerable quantities of waste in the form of acid tar as well as of the bleaching clay filter cake, likewise represent a considerable ecological problem.

Therefore, the art has been searching for some other process which would lead in an economical manner to high grade, secondary raffinates, ecologically justifiable at the same time and producing as little waste material as possible.

Thus, an entire series of processes have previously been proposed in the case of which a generally large part of the inpurities contained is separated even before the acidification by additional chemical and physical treatment of the used oils, in order to decrease the amount of sulfuric acid needed for the oil and thus to produce smaller qualities of the undersirable acid tar. After that, the used oils are to be subjected, for example, to a solvent extraction prior to the acid treatment, a total evaporation, possibly with the addition of substances with alkaline reaction, to a coagulation by means of hydroxides of multivalent metals or to a hot treatment.

However, all these processes have not yet brought about a decisive breakthrough away from the classic acid tar process, for the reasons that the additional processing steps adversely affect the economy of the process; a further waste product is produced and because the waste producing steps of the acidification and treatment with bleaching clay must be carried out just as before with filtration.

Processes which operate entirely without acid treatment have also been previously described. In most cases, these known methods are combination of distillation, hydrogenation and filtration. The catalytic hydrogenation which otherwise plays a predominant role in the case of refining of hydrocarbons, is however less suitable in the case of the regeneration of used oils for two reasons: lubricating oil additives and their decomposition products as well as a halogen content that can never be excluded entirely, act as catalyst poisons and require a more or less expensive prepurification of the oils, for example, by total evaporation or solvent extraction. Beyond that, the necessary hydrogen is not economically available in the case of most medium size enterprises.

Two additional processes, described in the German Pat. No. 11 05 543 and the German OS No. 25 08 713 carry out a chemical treatment with sodium metal, but also only partially avoid the above mentioned disadvantages.

A variation according to the practice of the process described in the German Pat. No. 11 05 543 provides for the treatment in the presence of bleaching clay of a used oil regenerate obtained according to the sulfuric acid process with about 1.5% by weight of sodium metal dispersed in the regenerate and then to filter off the treatment product by way of additional bleaching clay. This process, however, is expensive because of the cost for the sodium metal and the bleaching clay and also was not able to gain grounds because of the difficulties encountered with the filtration of alkaline oils, particularly because of the high content of additives in today's lubricating oils, the requirement for auxiliary agents for filtering would have to be increased by a multiple of the originally provided volume with an unfavorable effect on the waste balance.

Another process described in the German OS No. 25 08 713 for the reprocessing of used mineral oil provides for the precleaning of the used oil by means of coagulation, adsorption, filtration as well as distillation and secondary treatment and to dehalogenize it subsequently in sequence, to distill it in a fractionated manner and to dehydrate it. For the dehalogenation, among others, a treatment with alkali metal in a volume rate of 1 to 2000 mole/1000 kilograms with exclusion of air and moisture at a reaction temperature of 15 to 300° C. is proposed. Excess treatment agents and the reaction products formed should be separated either by distillation or by a cleaning treatment of the oil. In the first case, excess agent is allowed to deposit, the oil is decanted and is then distilled in the vacuum. In the second case, excess agent is destroyed with water, the oil is then cleaned with a diluted sulfuric acid and subsequently several times with water, is dried and filtered. Both alternatives are followed by the catalytic hydrogenation.

The large number of treatment steps alone is an impediment to an economic execution of this process. If one limits the observation to the step of the dehalogenation and the separation of oil and excess of processing agents, as well as to reaction products formed by decanting and distilling, then the last mentioned measure is made a great deal more difficult through the so-called "gum-formation," a resinification of the oil occurring in the case of all used oil treatment processes with alkali metal. This resinification is the more extensive, the higher the added quantity of the alkali metal and the higher the treatment temperature. Thus, for example, in the case of a distillation of oils treated at 100° to 250° C. with 1 to 2% by weight of sodium metal in the wetted wall distillation process, such strong spraying occurs that a double total evaporation may not be avoided and one must put up with a poorly distilled out residue of considerable volume.

If on the other hand, the processing of the oil from the dehalogenation stage by filtration is selected, then this presupposes the very expensive washing and drying process described.

SUMMARY OF THE INVENTION

The invention is based on the task of creating a procedure for the reprocessing of used lubricating oils which, without needing expensive precleaning and secondary treatment stages, proceeds with a treatment of the dried, used oil with finely dispersed sodium metal in a surprisingly simple method of separation avoiding the disadvantages of the known processes and yielding a pure end product directly.

The object of the invention is a process for the reprocessing of used lubricating oils by treating the dried oil with finely dispersed sodium metal at an elevated temperature and subsequent separation of the treated product by distillation. The process is characterized in that one process with 0.3 to 3.0% by weight of sodium for 1 to 15 minutes at temperatures of 50° and 200° C., then one decomposes the residue-free and/or organically bound metal by means of active hydrogen compounds and thereafter distills the oil.

In following the method of the invention, one may omit especially the separation of the sodium treatment oil from the sedimented excess agent by decantation of the distillation state. Any gum formation which takes place with heating at distillation temperatures which are customarily between 200° and 350° C., as well as during the carrying out of the distillation, will be practically completely avoided. The distillate is obtained in a large yield and high purity, the distillation residue is greatly decreased.

In practicing the process according to the invention, it is advantageous to carry out the sodium treatment for a time between 2 and 10 minutes at reaction temperatures between 90° and 160° C. At the same time, one processes effecitvely with 0.5 to 2% by weight of sodium, which desirably has a mean particle diameter of at most 100 μm, preferably below 30 μm.

The decomposition may be carried out with liquid or gaseous steam, but also with hydrogen peroxide, primary alcohols with 1 to 3 carbon atoms or with mixtures of these compounds.

In the case of decomposition with fluid water, its volume of addition should not be increased too much, because otherwise in the case of subsequent heating up to the distillation temperatures, excessive pressure surges might occur. It is desirable to decompose the alkali metal radicals and the alkali metal containing reaction product prior to heating with 0.1 to 2.0%, preferably 0.2 to 1.0% by weight, of water.

The process is synchronized such that the metering of the quantities of alkali metal for all types of lubricating oil customarily used and obtained, may be adjusted in the range provided above. These quantities are relatively low. Thus, the development of hydrogen is slight, too, and easy to control, which, in the case of decomposition of the remaining alkali metal, is formed with the required low quantity of decomposition agent. Water inserted does not disturb, since customarily one distills subsequently by means of stripping steam, as a result of which a far reaching deodorization of the end product will be achieved. A special advantage will be achieved with the variation of the process in case of which the oil is distilled off directly from the processing medium. For this purpose, a sodium treatment and a decomposition of the residue-free and/or organically bound metal is accomplished in a vessel provided with a distillation arrangement and the distillation of the oil follows directly after these two processing steps.

Whenever one does not use hydrogen peroxide as a decomposition agent from the vary beginning, hydrogen peroxide may be added to the decomposition agent used in an empirically determined quantity for deodorizing the treatment material.

DETAILED DESCRIPTION OF THE INVENTION

The invention will be explained further subsequently in connection with embodiments by way of the following examples.

The "waste oils" used were subjected always prior to carrying out the process to drying to thermal treatment. Generally, the oils are heated at temperatures between 100° and 200° C. and under standard pressure to obtain the desired dried condition for operation of the invention.

For carrying out the embodiments given by way of example, among others, two dried, used oils from practice were made use of which were characterized by the following analytical values:

| | waste oil I | waste oil II |
|---|---|---|
| Water | 0.15% | 0.24% |
| Ash | 0.7% | 1.0% |
| Halogen (as Cl) | 0.32% | 0.28% |
| Sulfur | 1.0% | 0.9% |
| C | 84.5% | 85.0% |
| H | 13.2% | 13.7% |
| N | 0.15% | 0.04% |
| Bromide number mg/g | 29 | 28 |
| Average molecular weight | 358 | 352 |

Heavy metal waste oil I:

Pb 1600, Ca 700, Al 18, Mg 120, Fe 151, Mn 5, Ni 1.4, Cr 5, Mo 7, Si 81, Zn 48, Na 87, Cu 37 ppm Heavy metal waste oil II:

Pb 800, Ca 1200, Al 90, Mg 220, Fe 582, Mn 10, Ni 7.0, Cr 14, Mo 37, Si 439, Zn 607, Na 247, Cu 40 ppm

Sodium Metal-Dispersion

A sodium metal dispersion from 1 part by weight of sodium metal and 2 parts by weight of spindle oil (viscosity at 50° C. between 2.0° and 3.0° E.) with an average particle size of about 10 μm was used. It was produced above the melting point of the alkali metal in a heatable agitator vessel with a high speed dispersion apparatus according to the rotor-stator principle.

Sodium Metal Requirement

Various quantities of sodium metal were added as a 33.3% dispersion at different temperatures to the dried, waste oil.

The mixture was stirred with an anchor screw with 240 revolutions per minute. The residual content of sodium metal was determined by gas-volumetric hydrogen analysis after decomposition with water.

The table provides a summary of the distribution of residual-free sodium and of sodium consumed during the treatment in dependence on temperature and time.

| Waste Oil | Addition of Sodium % | Treatment temperature °C. | Residual Content of Na Metal in % after: 1 | 3 | 5 | 7 | 10 | 15 min. |
|---|---|---|---|---|---|---|---|---|
| I | 1.0 | 50 | 0.80 | 0.75 | 0.70 | 0.70 | 0.70 | 0.70 |
| | 1.0 | 100 | 0.30 | 0.25 | 0.20 | 0.20 | 0.15 | 0.15 |

-continued

| Waste Oil | Addition of Sodium % | Treatment temperature °C. | Residual Content of Na Metal in % after: 1 | 3 | 5 | 7 | 10 | 15 min. |
|---|---|---|---|---|---|---|---|---|
| | 1.0 | 150 | 0.25 | 0.15 | 0.13 | 0.13 | 0.12 | 0.10 |
| | 1.5 | 150 | 0.80 | 0.65 | 0.65 | 0.60 | 0.55 | 0.50 |
| II | 1.0 | 110 | 0.15 | 0.14 | 0.12 | 0.10 | 0.08 | 0.05 |
| | 1.0 | 190 | 0.05 | 0.05 | 0.04 | 0.03 | 0.01 | 0.00 |
| | 2.0 | 190 | 0.70 | 0.55 | 0.40 | 0.25 | 0.25 | 0.10 |

EXAMPLE 1

Continuous treatment of used oil in an agitator vessel cascade.

In a heatable agitator vessel a sufficient volume of dried, used oil 2 is heated to 105° C. and is moved at a speed of 30 kg/hour into an agitator vessel, in which it is mixed with 1.5 kg of the previously mentioned sodium dispersion per hour. With a total delay time of about 5 minutes, the used oil thus mixed with 1.7% sodium metal is conveyed by way of two additional agitator vessels into a fourth agitator boiler, in which the sodium metal which has not yet completely reacted, as well as the highly reactive sodium metal derivative products are decomposed with 0.3 kg of water per hour (corresponding to 1.0% by weight related to the used oil). The oil which has been heated by treatment to about 140° C. runs from the decomposition vessel into a supply container.

10 kg of the oil treated thus are subjected to a vacuum distillation in a distillation flask. At the same time, one will obtain the following fractions:

| Fraction | Quantity | Head-/Sump-temperature °C. | °C. | Pressure mbar | Visc. °E (50° C.) | Density | Color |
|---|---|---|---|---|---|---|---|
| 1 (gas oil) | 1,910g | 225 | 250 | 20 | — | 0.849 | colorless |
| 2 (Spindle oil) | 1,850g | 285 | 305 | 20 | 2.6 | — | bright yellow |
| 3 (base oil) | 4,850 | 285 | 340 | 1.5 | 6.8 | 0.878 | yellow |
| Sump | 1,300g | — | — | — | — | — | black |
| Water | 90g | — | — | — | — | — | — |
| Total | 10,000g | | | | | | |

EXAMPLE 2

5,000 g. of dried, used oil (used oil 1, see introduction to the examples, above) is treated at 150° C. under a nitrogen atmosphere with 1% sodium metal (as a 33% dispersion in spindle oil, cf. introduction). The reaction is stopped after 5 min. with 25 g of water (corresponding to 0.5% by weight).

The oil treated thus is heated under standard pressure to 360° C. and is left at this temperature for 5 min., whereby the water and a small quantity of easily boiling hydrocarbons is distilled off.

The oil is subsequently fractionated in a (thin)-film evaporator with 0.05 $m^2$ of jacket surface. For this purpose, it will be placed into the evaporator three times in succession with a dosing-in speed of 0.9 kg/hour at different wall temperatures of the evaporator and different pressures, the rotor of said evaporator running at about 600 rpm. One will obtain the following fractions:

| Fraction | Quantity g | % | Distillation temperature wall °C. | head °C. | Pressure mbar | Density g/cm³ | Visc. °E. (50° C.) | Color |
|---|---|---|---|---|---|---|---|---|
| 1 (gas oil) | 1,110 | 22.2 | 210 | 175 | 5 | 0.84 | — | colorless |
| 2 (spindle oil) | 1,230 | 24.6 | 290 | 225 | 5 | — | 2.4 | bright yellow |
| 3 (base oil) | 1,950 | 39.0 | 350 | 280 | 1.5 | 0.88 | 7.3 | yellow |
| Sump | 665 | 13.3 | — | — | — | — | — | black |
| Water | 20 | 0.4 | — | — | — | — | — | — |
| First runnings | 25 | 0.5 | — | — | — | — | — | — |
| Total | 5,000 | 100 | | | | | | |

| Analytical Values Fraction 3 | Unit | Regulation | Value |
|---|---|---|---|
| Viscosity at −17.8° C. | m Pa.s | DIN 51377 | 9600 |
| Viscosity at 40.0° C. | $m^2/s$* | DIN 51562 | $80.45 \times 10^{-6}$ |
| Viscosity at 100.0° C. | $m^2/s$* | DIN 51561 | $9.35 \times 10^{-6}$ |
| Density at 15° C. | g/ml | DIN 51757 | 0.888 |
| Point of ignition after Cleveland | °C. | DIN 51376 | 258 |
| Pour point | °C. | DIN 51583 | −14 |
| Viscosity index/VI | — | DIN 51564 | 91 |
| Sulfur content | % by weight | DIN 51768 | 0.63 |
| Sulfate ash | % by weight | DIN 51575 | 0.00 |
| Coke residue after Conradson | % by weight | DIN 51551 | 0.05 |
| Loss by evaporation | % by weight | DIN 51581 | 6.8 |
| Corrosion effect on copper | Note | DIN 51579 | 1 |

*kinematic viscosity

The oil contains about 1 ppm of heavy metals (0.2 ppm Fe, 0.01 ppm Ca, 0.4 ppm Mg, 0.3 ppm Al)

The base oil thus corresponds to the requirements which have to be made of a high grade lubricating oil.

EXAMPLE 3 (Comparison in the method of operation with and without addition of water)

500 g of dry oil (used oil 2) are mixed at 120° C. with 1.5% sodium metal (4.5% of 33% dispersion of spindle oil, cf, introduction). As a result of the reaction of the used oil with the sodium, the temperature rises to 140° C. After 5 minutes the reaction of the sodium with the used oil is stopped by the addition of 0.5% of water.

The sample is distilled in a fractionated manner in a 1 L-distillation flask in the vacuum.

In a parallel experiment, one proceeds exactly the same way; the water treatment is omitted, the sample is heated after 5 minutes of reaction time with the residual-free and organically bound sodium metal to the distillation temperature.

The distillation of the two samples produces the following results:

Sample 1 (addition of water after 5 min.) duration of distillation altogether 1 h 40 mins.

| | Quantity | | Distillation temp. (max) °C. | | pres- | Visc. | Den- |
|---|---|---|---|---|---|---|---|
| Fraction | g | weight- % | head | sump | sure mbar | °E. (50° C.) | sity g/cm³ |
| 1 | 127 | 24.2 | 225 | 255 | 20 | — | 0.845 |
| (gas oil) | 12 | 112.5 | 21.4 | 285 | 305 | 20 | 2.9 |
| (spindle oil) | | | | | | | |
| 3 | 221 | 42.1 | 340 | 310 | 1.5 | 6.7 | |
| (base oil) | | | | | | | |
| Sump | 63 | 12.0 | — | — | — | — | |
| Water | 1.5 | 0.3 | — | — | — | — | |

Sample 2 (without addition of water) duration of distillation 2 hours, 20 min.

| | Quantity | | Distillation temp. (max) °C. | | pres- | Viscosity | Den- |
|---|---|---|---|---|---|---|---|
| Fraction | g | weight- % | head | sump | sure mbar | °E. (50° C.) | sity g (cm³) |
| 1 | 132 | 25.3 | 225 | 255 | 20 | — | 0.84 |
| (gas oil) | | | | | | | |
| 2 | 109 | 20.9 | 285 | 305 | 20 | 2.9 | — |
| (spindle oil) | | | | | | | |
| 3 | 195.5 | 37.4% | 340 | 270 | 1.5 | 6.1 | — |

-continued

| | Quantity | | Distillation temp. (max) °C. | | pres- | Viscosity | Den- |
|---|---|---|---|---|---|---|---|
| Fraction | g | weight- % | head | sump | sure mbar | °E. (50° C.) | sity g (cm³) |
| (base oil) | | | | | | | |
| Sump | 86 | 16.4% | — | — | — | | |

The comparison shows that in the case of working according to the invention, the yield of highest boiling fractions is increased and the portion of the sump is decreased. The highest boiling fraction furthermore has a more favorable viscosity. Finally, the duration of distillation is shortened by about one third.

We claim:

1. A process for the reprocessing of used lubricating oils by treating dried oil with finely dispersed sodium metal at an elevated temperature and subsequent separation of the treated product by distillation, the improvement consisting essentially of the oil being treated for 1 to 15 minutes at temperatures between 50° and 200° C. with 0.3 to 3.0% by weight of sodium, wherein the sodium has an average particle diameter of at most 100 μm, the remaining free and/or organically bound metal being then decomposed by means of fluid water in the amount of 0.1 to 2.0% by weight and after that the oil is distilled, said improvement eliminating the need for a preliminary purification step, mechanical removal of residual metal and an after treatment step.

2. The process as in claim 1, wherein the sodium treatment is carried out for 2 to 10 minutes at 90° to 160° C.

3. The process as in claim 1 or 2, wherein from 0.5 to 2% by weight of sodium is used.

4. The process as in claim 1 or 2, wherein the sodium has an average particle diameter below 30 μm.

5. The process as in claim 1, wherein the decomposition is carried out with 0.2 to 1.0% by weight of water.

6. The process as in claim 1 or 2, wherein the distillation is carried out with stripping steam.

7. The process as in claim 1 or 2, wherein the oil is distilled of directly from the processing medium.

* * * * *